United States Patent [19]

Kamimura et al.

[11] 3,975,937

[45] Aug. 24, 1976

[54] METHOD AND APPARATUS FOR SUPPLYING PLUGS TO PLUG MILLS

[75] Inventors: Haruo Kamimura; Yukio Yamashita, both of Yokohama; Toshitugu Nakai, Tokyo; Katsumi Wadano, Yokohama; Kozo Amada, Yokohama; Yoshitane Matsuda, Yokohama, all of Japan

[73] Assignee: Nippon Kokan Kabushiki Kaisha, Tokyo, Japan

[22] Filed: Nov. 26, 1975

[21] Appl. No.: 635,313

[30] Foreign Application Priority Data

Nov. 30, 1974 Japan ..... 49-136621
Sept. 16, 1975 Japan ..... 50-125957

[52] U.S. Cl. ..... 72/209
[51] Int. Cl.[2] ..... B21B 25/06
[58] Field of Search ..... 72/209, 201, 202, 97, 72/208

[56] References Cited

UNITED STATES PATENTS

| | | | |
|---|---|---|---|
| 1,537,206 | 5/1925 | Wikstrom | 72/209 X |
| 2,635,492 | 4/1953 | Gettig | 72/209 |
| 2,699,697 | 1/1955 | Kelso | 214/146.5 |
| 3,277,687 | 10/1966 | Kelly | 72/209 |

*Primary Examiner*—Milton S. Mehr
*Attorney, Agent, or Firm*—Flynn & Frishauf

[57] ABSTRACT

In a plug mill, the plug is contained in a container supported by a carriage which is moved from the plug recovering position to the inlet guide provided in front of the mill along a straight transfer rail positioned at an angle with respect to the pass line of the mill and at a speed sufficient to impart a predetermined moment of inertia to the plug. When the carriage is advanced to a position near the inlet guide, the carriage is rapidly stopped to eject and supply the plug to the front end of the mandrel bar by utilizing the moment of inertia.

10 Claims, 6 Drawing Figures

METHOD AND APPARATUS FOR SUPPLYING PLUGS TO PLUG MILLS

BACKGROUND OF THE INVENTION

This invention relates to a method and apparatus for supplying a plug to a plug mill.

When a tubular blank is rolled by a plug mill it is necessary to insert a plug into the blank before it is rolled. To supply the plug to the inlet side of the mill, it has been the practice to hold the plug by rod shaped tools termed tongues in combination with a lever and a cylinder. In any case the manual power of the operator was relied upon for handling the plug. Moreover, such hard work must be done at high temperatures and in atmosphere containing dust and scale. Since the weight of the plug often exceeds several tens Kg and its sectional configuration is semicircular so that the plug has a tendency to roll and incline. Accordingly, it is not easy to bring such plug to the inlet side of the plug mill by holding it by tongues. Such operation requires heavy work and skill of the operator. If these operations are not performed correctly, the plug drops with the result that not only the plug but also associated machine parts would be damaged. Moreover, when the plug is not maintained at the correct position when the blank is inserted a jamming or other troubles prevent normal rolling operation. Handling of heavy plug requires a large labour and time thus reducing the efficiency of the milling operation. Usually, a group of workmen attends one plug mill so that where several shifts are made per day it is necessary to employ several groups of workmen. Accordingly a number of proposals have been made to save the labour such as those described in U.S. Pat. Nos. 1,537,206 and 1,931,571. In the former, it was assumed that the plug is spherical and its rolling property is utilized to transfer it into a caliber. Such assumption, however, holds true only when the plug is spherical and wear uniformly. Actually however, since it is difficult to always maintain perfect spherical configuration due to nonuniform wear thus producing products having nonuniform wall thickness. In an extreme case, the plug will remain in the product, or thicker part will be performed at the entrance of the product. The mechanism of the later patent is complicated because of many movable elements so that it is not suitable to apply it to a plug mill. For the reason described above, in many plug mills, the plugs are still supplied manually.

SUMMARY OF THE INVENTION

Accordingly it is an object of this invention to provide an improved method and apparatus for supplying a plug to a plug mill capable of obviating difficulties described above.

Another object of this invention is to provide an improved apparatus for receiving a plug ejected from a plug mill and for automatically supplying the plug to the mandrel bar by utilizing the moment of inertia imparted to the plug while it is conveyed from the plug recovering position to the inlet guide of the plug mill.

A further object of this invention is to provide an improved method and apparatus for supplying a plug to a plug mill capable of positively recovering and supplying the plug even when the distance between the plug recovering position and the plug mill is relatively large.

Still further object of this invention is to provide an improved apparatus including a novel plug elevating mechanism capable of recovering a plug ejected from the mill and transferring the recovered plug into a container.

Yet another object of the invention is to provide an improved plug recovering and supplying apparatus which is located on one side of the pass line so that it does not interfere with the normal operation of the mill.

According to one aspect of this invention, there is provided a method of supplying a plug to a plug mill comprising the steps of accommodating the plug in a container, moving the container from the plug recovering position toward an inlet guide in front of the mill rolls at a speed sufficient to impart a predetermined moment of inertia to the plug and along a straight transfer line at an angle with respect the pass line of the mill and quickly stopping the container when it reaches the inlet guide thus ejecting the plug by utilizing the moment of inertia and feeding the plug to a mandrel bar of the plug mill.

According to another aspect of this invention there is provided apparatus for supplying a plug to a plug mill comprising a substantially straight transfer rail mechanism extending between a plug recovering position and inside of an inlet guide for the plug mill, said transfer rail mechanism being positioned at an angle with respect to the pass line of the mill, a carriage carrying a container for accommodating a plug and movable along the transfer rail mechanism, means for driving the carriage at a speed sufficient to impart a predetermined moment of inertia to the plug, and means for rapidly stopping the carriage at a point near the inlet guide so as to eject the plug out of the container by utilizing the moment of inertia thereby feeding the plug to the front end of a mandrel bar.

The movement of the carriage is accomplished by a cord connected to the carriage and passing about spaced pulleys and by driving one of the pulleys or by means of a piston cylinder assembly.

According to this invention there is also provided a novel plug elevating mechanism including a plug receiving platform movable in the vertical direction along tiltable guide frames, whereby a plug discharged from the plug mill is received by the plug receiving platform and then transferred into a container. Inspection, cooling and supply of lubricant to the plug are possible while the plug is being supported by the plug receiving platform.

BRIEF DESCRIPTION OF THE DRAWINGS

Further objects and advantages of the invention will be more fully understood from the following detailed description taken in conjunction with the accompanying drawings, in which.

DESCRIPTION OF THE PREFERRED EMBODIMENTS

Figure 1:
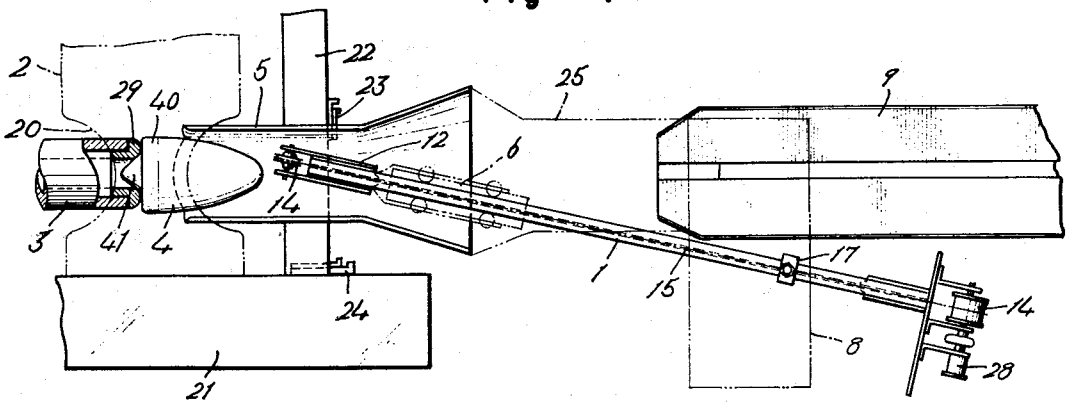
FIG. 1 is a plan view of the plug supplying apparatus embodying the invention.
Figure 2:
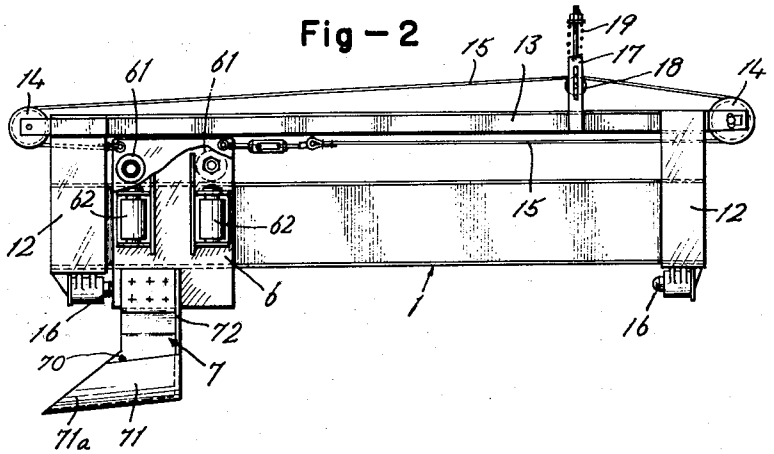
FIG. 2 is a side view showing the transfer rail mechanism utilized in the apparatus shown in FIG. 1.

In a preferred embodiment of this invention shown in FIGS. 1 and 2, adjacent a mill stand 21 including rolls 2 provided with calibers 20 is disposed a rest bar 22 for securing an inlet guide 5. The rest bar 22 is secured to the stationary member of the mill by a fixing member 24 and the inlet guide 5 is adjustably secured to the rest bar 22 by a fixing member 23 in a manner well known in the art. As shown, the inlet guide 5 is directed to the calibers 20. A plug recovering chute 25 is disposed in front of and beneath the inlet guide 5 and a front table for receiving a workpiece, for example a steel tube, is mounted above the recovering chute 25.

According to this invention, there is provided a transfer rail mechanism 1 with its front end protruded into the inlet guide 5. As shown in FIG. 1, the transfer rail mechanism 1 is substantially linear and incline at a small angle with respect to the pass line of the mill hereby interconnecting the caliber 20 and the front table 9 such that the rail mechanism 1 and the bucket 7 carried thereby will not contact the inlet guide 5 and the front table 9. As will be described later, the rear end of the transfer rail mechanism 1 is disposed above a plug elevating mechanism 8 laterally extending on the front end of the plug recovering chute 25.

Figure 3:
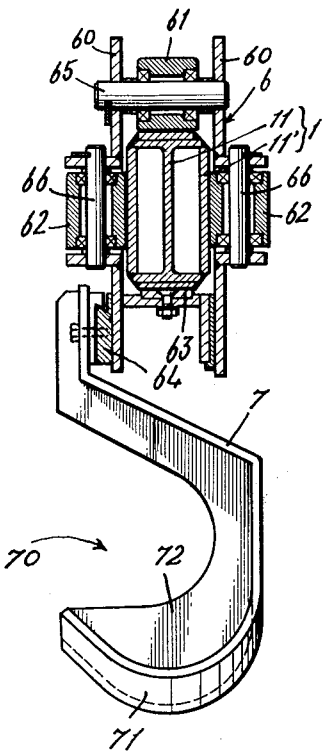
FIG. 3 is a sectional view of the carriage.

With reference now to FIGS. 2 and 3, the transfer rail mechanism has a shape of a box composed of an H section steel 11 and side plates 11' closing the both sides of the H section steel 11. Upwardly projecting supporting members 12 are secured to the opposite ends of the transfer rail mechanism 1 and the upper ends of the supporting members 12 are interconnected by a beam 13 having pulleys 14 rotatably mounted on the opposite ends thereof. A pulling cord or wire 15 is passed about the pulleys 14 and the opposite ends of the cord are connected to a carriage 6 mounted on the rail mechanism. A pair of opposed stop members 16 are secured to the lower ends of the supporting members 12 for limiting the stroke of the carriage 6 and to accurately stop the carriage 6 even when it collides against the stop members at a considerable speed. The pulling cord 15 is driven by a driving mechanism 28, for example a pressure oil motor or an electric motor connected to one pulley 14, and the tension of the cord 15 is maintained at a constant value by means of a roller 18 engaging an intermediate point of the cord and biased by a spring supported by a support 17 connected to the beam 13.

As best shown in FIG. 3, the carriage 6 running along the transfer rail mechanism 1 comprises two side plates 60 secured to the opposite sides of the box like rail mechanism 1, a plurality of vertical rollers 62 supported by the side plates 60 through shafts 66, a plurality of horizontal rollers 61 mounted on shafts 65 extending between the side plates 60 and a liner 63 engaging the lower surface of the rail mechanism. As shown, the vertical and horizontal rollers 62 and 61 engage the opposite side surfaces and the upper surface, respectively, of the box like rail mechanism. A bucket 7 for accommodating the plug is secured to the lower end of one of the side plates 60 through a supporting member 64 by means of bolts. As shown in FIGS. 2 and 3, one side of the bucket is opened to form an opening 70 for receiving the plug, and the bottom 71 of the bucket is curved corresponding to the contour of the plug. As shown in FIG. 2, the curved bottom projects slightly in the forward direction to form a projection 71*a*. A rear plate 72 is secured to the curved bottom 71 as shown in FIG. 3. During operation, said opening 70 is arranged under the rale 1 and the bucket is mounted such that its projection 71*a* is directed toward the caliber 20. The rear plate 72 engages the front side of the plug received in the bucket so as to prevent the plug from dropping.

One example of the configuration of the plug suitable to carry out the method of this invention is shown in FIG. 1. More particularly, the plug 3 has a configuration resembling to that of a bullet. Thus, its length is substantially larger than the diameter and a rolling member 40 is secured to the end, the rolling member 40 having a cylindrical periphery that determines the inner diameter of the rolled tube and provided with a conical projection 41 extending in the axial direction. The bullet shaped plug is dropped into the bucket 7 through opening 70 and stably received in the curved bottom 71 whereby the rolling and inclination of the plug can be prevented during transportation. When the plug 4 is loaded in the caliber 20 of the mill rolls 2 its conical projection is directed toward the front end of a mandrel bar 3. In other words, the conical projection 41 is received in or positioned close to the inner opening of the bar cap 29 secured to the front end of the mandrel bar 3 which is maintained at a predetermined position. At the commencement of the rolling operation, the conical projection 41 is received in the bar cap 29.

Figure 4:
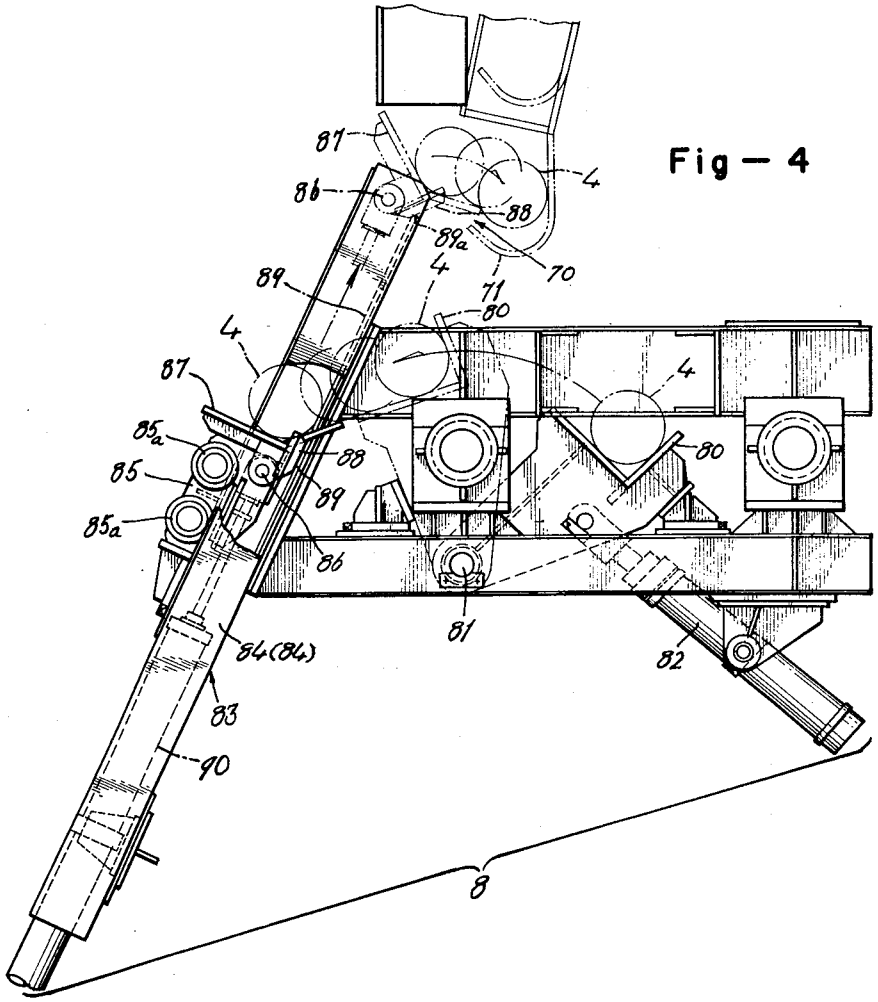
FIG. 4 is a side view, partly in section showing the plug elevating mechanism utilized in the apparatus shown in FIG. 1.

The plug elevating mechanism 8 arranged between the plug recovering chute 25 and the transfer rail mechanism 1 may be of any suitable type. FIG. 4 shows a preferred construction. When the rolling operation of a metal (steel) pipe is completed the plug 4 is removed from the mandrel bar 3 by a suitable plug ejecter as disclosed in U.S. Pat. No. 3,879,972 to the same applicant, and the plug 4 thus removed is transferred to a rotatable platform 80 of the elevating mechanism 8 via recovering chute 25. The platform 80 is rotated about a pivot pin 81 by an operating cylinder 82 from solid line position to dotted line position as shown in FIG. 4. There is provided an elevating mechanism 83 which is inclined such that the righthand side near the upper end of the elevating mechanism is positioned near the rotatable platform 80 when it is rotated to the dotted line position. The elevating mechanism 83 is provided with side frames 84 on both sides and the wheels 85*a* of a carriage 85 ride on the lefthand or upper surfaces of the frames 84. A plug receiving platform 87 is rotatably mounted on the upper end of the carriage 85 by means of a pivot pin 86 and a shoe 88 secured to the righthand side of the plug receiving platform 87 slides along a rail 89 secured to the rear surface of the guide frames 84. The movable carriage 85 is moved substantially in the vertical direction by an operating cylinder 90 secured to the lower portion of the elevating mechanism 83. The upper end 89*a* of rail 89 terminates a little short from the upper end the guide frames 84, so that when the shoe 88 of the carriage 85 reaches the upper end 89*a* of the rail, the plug receiving platform 87 will tilt under its own weight to the dotted line position from the solid line position about the pivot pin 86 thus transferring the plug into the curved bottom portion of the bucket 7 through opening 70 positioned as described above. At this time, the bucket 7 is held stationary with its righthand side engaged with righthand stop member 16. After receiving the plug, the bucket is moved in the forward direction along the rail mechanism 1.

The plug supplying apparatus described above operates as follows. The transfer rail mechanism is secured to the inlet guide or the front table 9. Accordingly, to change the caliber 20 used in the mill roll, the transfer rail mechanism is moved together with the inlet guide 5 or by the transverse movement of the front table 9. As has been described hereinabove the transfer rail mechanism 1 is provided with a plug supplying mechanism including carriage 6 and bucket 7 so that when the transfer rail mechanism is secured to the inlet guide 5 they constitute an integral unit. Accordingly each inlet guide 5 of the rolling mill is provided with a plug supplying mechanism. On the other hand, where the transfer rail mechanism is secured to the front table 9, the same combination can be used for respective inlet guides. Of course the bucket 7 is exchanged for calibers 20, and hence the plugs 4 of different size. The plug is supplied in the following manner. The plug 4 elevated by the elevating mechanism 8 shown in FIG. 4 is received by bucket 7 in the retracted position. In this case, if it is necessary to inspect the plug before use, such inspection is made while the plug is supported by the plug receiving platform 87 maintained at the lower portion of the elevating mechanism. When a damaged plug is detected it is exchanged with a new one. Lubricant is also applied to the plug at this position. Although not shown in the drawing, the plug is cooled by water spray while it is carried by the elevating mechanism. When the plug is received in the bucket 7, immediately after completion of the return stroke of the blank of the pipe through the mill the driving mechanism 28 is operated to move forwardly the carriage 6 together with bucket 7 along the transfer rail mechanism 1. It is advantageous to select the running speed of the carriage 6 such that it is higher than 1.5 m/sec. when the carriage reaches the plug supplying position (the position when the carriage reaches the lefthand stop 16 as viewed in FIG. 2). When such running speed is selected it is possible to quickly stop the carriage 6 and the bucket 7 by the stop 16 so that the plug is ejected from the bucket to the desired position of supply. Usually, the running speed is in a range of from 2 to 5 m/sec.

Figure 5:
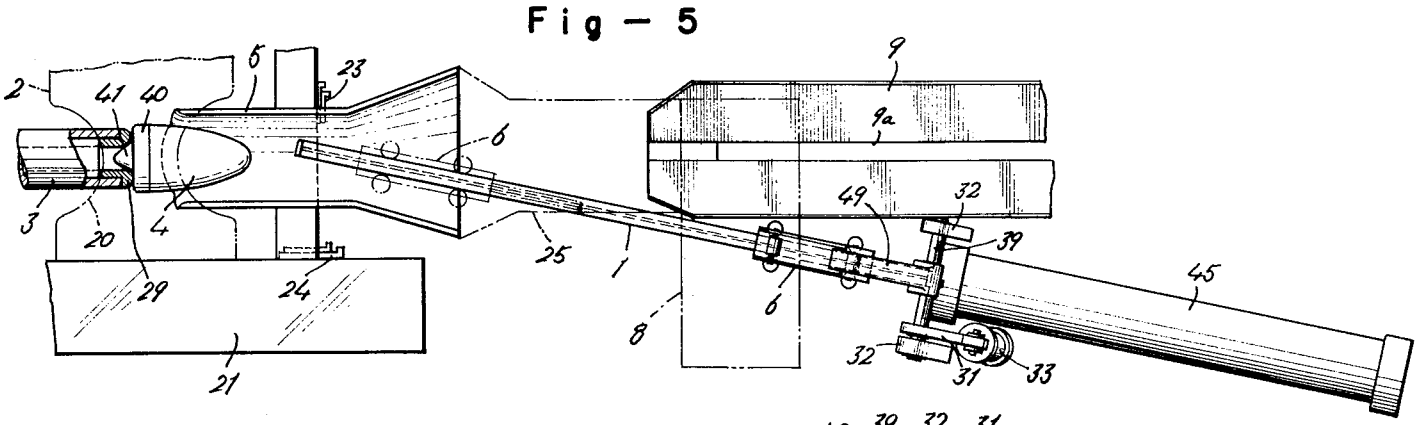
FIG. 5 is a plan view showing a modified embodiment of this invention.
Figure 6:
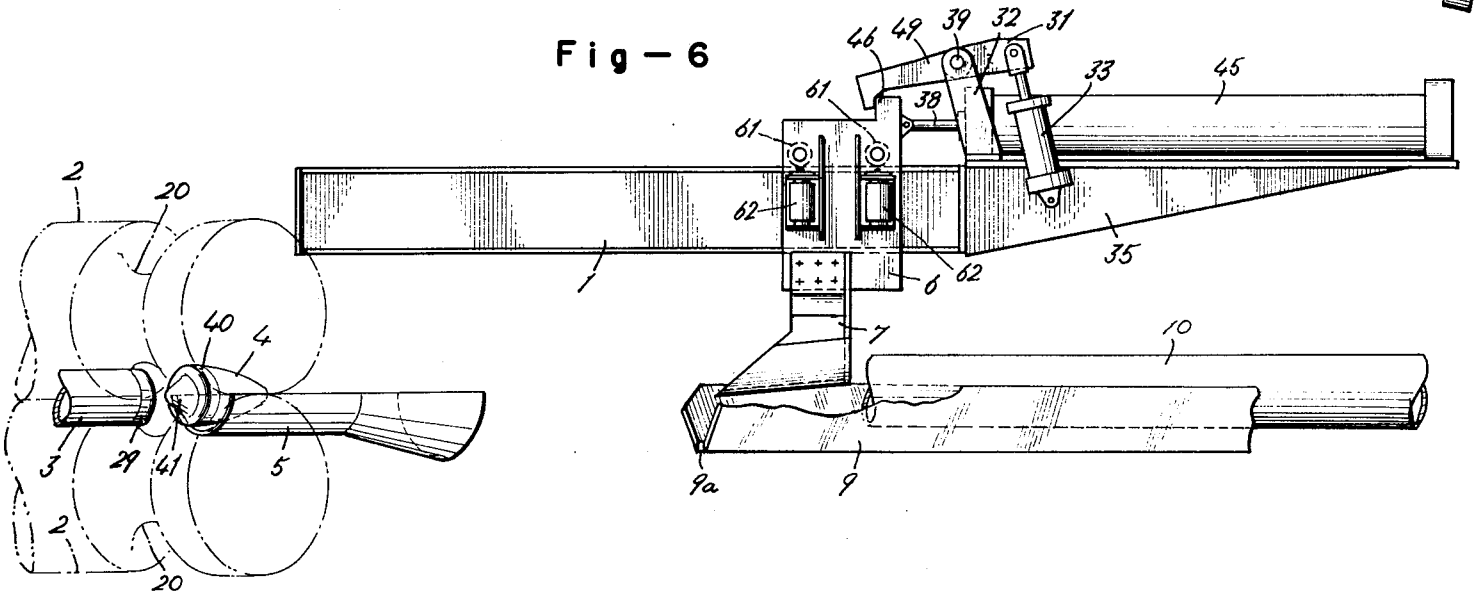
FIG. 6 is a side view of the transfer rail mechanism utilized in the modified embodiment shown in FIG. 5.

FIGS. 5 and 6 show a more compact embodiment of this invention. In the previous embodiment described above, since a pulling cord is used to move the carriage it is possible to positively recover the plug even when the distance between the plug recovering position and the mill roll amounts to 2 or 3 meters or more. Moreover, it is not necessary to increase the driving power for such large distance. When the distance between the plug recovering position and the mill is large as above described, inspection, cooling and application of the lubricant can be made readily without interfering with the rolling operation. However, it is also possible to set the plug recovering position at a smaller distance than 2 m, for example about 1.5 m. The modification shown in FIGS. 5 and 6 is suitable for this case. The mill roll 2 of the mill stand 21 has substantially the same construction as that shown in FIGS. 1 and 2. Further, the inlet guide 5, recovering chute 25, front table 9 have substantially the same construction as those of the previous embodiment. The inclined arrangement of the transfer rail mechanism with respect to the pass line of the mill and the cross-sectional configuration of the transfer rail mechanism are also substantially the same as those of the previous embodiment, but the length of the transfer rail mechanism is substantially shorter than that of the first embodiment. Pulleys 14, pulling cord 15 and stops 16 are eliminated.

In the modified embodiment shown in FIGS. 5 and 6, mill rolls 2 each having caliber 20 is provided for the mill stand 21, and on the entry side of the rolls 2 is positioned an inlet guide 5. A longitudinal groove 9*a* is provided for the V shaped front table 9 for removing scale. A blank pipe 10 is supported by the front table 9. A mandrel bar 3 is positioned on the outlet side of the rolls for receiving the projection 41 of the plug 4 in the central opening of the mandrel bar 3 thereby holding the plug in a predetermined relative position. Again the transfer rail mechanism 1 is inclined at a proper angle with respect to the pass line, and a carriage 6 carrying a bucket 7 is moved along the transfer rail mechanism 1. As before the guide rail mechanism 1 is constituted by a H beam and other members. The carriage 6 is guided by horizontal rollers 61 and side rollers 62 running along the upper and side surfaces, respectively of the transfer rail mechanism. A support 35 is connected to the rear end of the transfer rail mechanism 1. An air cylinder 45 for loading the plug is positioned above the support 35 and the piston rod of the air cylinder is connected to carriage 6 for reciprocating the bucket 7. pedestals 32 are secured to the front end of the support 35 to pivotally support a locking lever 49 by a pivot pin 39 which is rotated by an operating cylinder 33 through an arm 31. The front end of the locking lever 49 cooperates with a projection 46 provided for carriage 6 for arresting the carriage in the retracted position.

As shown in FIG. 6, the inlet side of the inlet guide 5 inclines downwardly so that the plug which is discharged from between rolls 2 upon completion of the rolling operation slides down along the inclined portion of the inlet guide and arrives at the plug receiving platform 87 shown in FIG. 4 via recovering chute 25. While the plug is being supported by platform 87, cooling and inspection of the plug and application of lubricant thereto are performed as above described. Thereafter, the plug is conveyed to bucket 7 which is maintained at the righthand end of the rail by operating a suitable elevating mechanism as shown in FIG. 4.

It is advantageous to use a bullet shaped plug having a length larger than the diameter and provided with a conical projection at the tail end instead of using a hemispherical plug which has been generally used in conventional plug mills because it is possible to smoothly load the plug into the mill and to positively mount the plug on the fore end of the advancing mandrel bar 3.

As has been described hereinabove, it is possible to load the plug automatically in an adverse operating environment involving high temperature and dust. Moreover, as the loading mechanism is constructed to load the plug by utilizing the moment or inertia of the plug imparted thereto by a simple straight rail mechanism, it is possible to greatly simplify the construction and operation of the loading mechanism thereby saving the labour and increasing the efficiency of the plug mill.

With the embodiment shown in FIGS. 1 and 2, it is possible to attain the object even when the distance between the plug recovering position and the mill rolls is relatively large whereas in the embodiment shown in FIGS. 5 and 6, as the plug contained in a bucket is loaded between the rolls by the operating cylinder it is possible to readily load the plug by using its moment of inertia. In this modification, the plug is loaded when the piston of the operating cylinder reaches the limit of its forward stroke so that the construction of this modification is simpler than that of the first embodiment because it is not necessary to use a pulling cord and pulleys for guiding the cord.

It should be understood that many changes and modifications will readily occur to one skilled in the art without departing from the true spirit and scope of the invention as defined in the appended claims.

What is claimed is:

1. A method of supplying a plug to a plug mill comprising the steps of accommodating the plug in a container, moving the container from a plug recovering position toward an inlet guide in front of the mill rolls along a substantially straight transfer line at a speed sufficient to impart a predetermined moment of inertia to the plug, said substantially straight transfer line being at an angle with respect to the pass line of the mill, and quickly stopping said container when it reaches said inlet guide, thus ejecting the plug by utilizing said moment of inertia and feeding the plug to the front end of a mandrel bar of the plug mill.

2. The method according to claim 1 comprising moving said plug along said substantially straight transfer line by a pulling cord.

3. The method according to claim 1 comprising moving said container containing the plug along said substantially straight transfer line by means of a piston-cylinder assembly.

4. The method according to claim 1 comprising accelerating said container containing the plug to a speed of 2 to 5 meters per sec.

5. Apparatus for supplying a plug to a plug mill comprising a substantially straight transfer rail mechanism extending between a plug recovering position and inside of an inlet guide for the plug mill, said transfer rail mechanism being positioned at an angle with respect to the pass line of the mill, a carriage carrying a container for accommodating a plug and movable along said transfer rail mechanism, means for driving said carriage at a speed sufficient to impart a predetermined moment of inertia to said plug, and means for rapidly stopping said carriage at a point near said inlet guide so as to eject said plug out of said container by utilizing said moment of inertia, thereby feeding the plug to the front end of a mandrel bar.

6. The apparatus according to claim 5 wherein said carriage is provided with wheels rolling on said transfer rail mechanism, and said container comprises an opening at one side for accommodating the plug, a bottom portion shaped to conform to the configuration of the plug, and a rear plate at the rear of said container.

7. The apparatus according to claim 5 wherein said means for driving the carriage comprises a plurality of spaced pulleys mounted on said transfer rail mechanism, a flexible cord passing about said pulleys, the opposite ends of said cord being connected to said carriage and wherein a stop member is secured to the front end of said transfer rail mechanism in the path of said carriage so as to rapidly stop the same.

8. The apparatus according to claim 5 wherein said means for driving the carriage includes a piston-cylinder assembly with its piston connected to said carriage.

9. The apparatus according to claim 8 which further comprises a support connected to the rear end of the transfer rail mechanism to support said piston cylinder assembly, a locking lever pivotally mounted on said support, means for operating said locking lever, and a projection mounted on said carriage and cooperating with said locking lever for arresting said carriage.

10. The apparatus according to claim 5 which further comprises a recovering chute for receiving a plug ejected to the front of the inlet guide, a plug elevating mechanism including guide frames, a plug receiving platform to receive a plug from said recovering chute, means for moving said plug receiving platform along said guide frames, and means for tilting said guide frames when said plug receiving platform reaches the upper end of said guide frames for transferring the plug into said container.

* * * * *